US010053254B2

(12) United States Patent
Wolff

(10) Patent No.: US 10,053,254 B2
(45) Date of Patent: Aug. 21, 2018

(54) DEVICE AND METHOD FOR LABELLING INDIVIDUAL PACKAGES FROM THE UNDERSIDE OF THE PACKAGE

(71) Applicant: Peter Wolff, Swisttal-Heimerzheim (DE)

(72) Inventor: Peter Wolff, Swisttal-Heimerzheim (DE)

(73) Assignee: Espera-Werke GmbH, Duisburg (DE)

( * ) Notice: Subject to any disclaimer, the term of this patent is extended or adjusted under 35 U.S.C. 154(b) by 610 days.

(21) Appl. No.: 13/953,145

(22) Filed: Jul. 29, 2013

(65) Prior Publication Data

US 2013/0312367 A1 Nov. 28, 2013

Related U.S. Application Data

(63) Continuation of application No. PCT/EP2012/051449, filed on Jan. 30, 2012.

(30) Foreign Application Priority Data

Jan. 31, 2011 (WO) ..... PCT/EP2011/051304

(51) Int. Cl.
*B65C 9/42* (2006.01)
*B65C 9/46* (2006.01)
(Continued)

(52) U.S. Cl.
CPC ..... *B65B 61/025* (2013.01); *B65C 1/021* (2013.01); *B65C 9/36* (2013.01)

(58) Field of Classification Search
CPC ..... B65B 61/025; B65C 9/08; B65C 9/26; B65C 9/36; B65C 9/42; B65C 9/46
(Continued)

(56) References Cited

U.S. PATENT DOCUMENTS 3,650,773 A * 3/1972 Bush ..... B65B 61/025 177/4
3,985,605 A * 10/1976 Treiber ..... B65C 1/021 156/384
(Continued)

FOREIGN PATENT DOCUMENTS

CN 1364720 A 8/2002
CN 101795941 A 8/2010
(Continued)

*Primary Examiner* — Hemant M Desai
*Assistant Examiner* — Mary Hibbert
(74) *Attorney, Agent, or Firm* — Reinhart Boerner Van Deuren P.C.

(57) ABSTRACT

A method for labelling packages comprising a feed unit for transporting a package, a printing device for printing a label detachably affixed to a carrier strip and an application unit for applying the printed label to the underside of the package. The printing device is arranged laterally outside the feed unit which comprises a label dispensing unit for dispensing the printed label with a directional component in a direction contrary to the package transport direction. The application unit comprises a manipulator means for the label, which moves along an axis extending transversely to the transport direction. The label, detached from the carrier strip, can be transferred onto the feed unit laterally outside the same in a first axial position of the manipulator means and can be brought close to the package, and can be applied onto the underside of the package in a second axial position of the manipulator means.

31 Claims, 4 Drawing Sheets

(51) Int. Cl.

| | |
|---|---|
| ***B65C 9/26*** | (2006.01) |
| ***B65B 61/02*** | (2006.01) |
| ***B65C 1/02*** | (2006.01) |
| ***B65C 9/36*** | (2006.01) |

(58) Field of Classification Search
USPC ..... 53/411; 156/566, 362, 365, 556, 574
See application file for complete search history.

(56) References Cited

U.S. PATENT DOCUMENTS

| | | | | |
|---|---|---|---|---|
| 4,895,614 | A * | 1/1990 | Trouteaud | B65C 1/023 156/542 |
| 6,006,808 | A * | 12/1999 | Ewert | B29C 66/8163 156/541 |
| 6,080,250 | A * | 6/2000 | Urban | B65C 9/1884 156/360 |
| 2007/0158029 | A1 | 7/2007 | Jenkins et al. | |

FOREIGN PATENT DOCUMENTS

| | | | |
|---|---|---|---|
| CN | 101873968 | A | 10/2010 |
| DE | 3831392 | A1 | 3/1990 |
| DE | 19545191 | A1 | 6/1997 |
| DE | 19727648 | A1 | 1/1999 |
| DE | 102007034698 | A1 | 1/2009 |
| DE | 102008032019 | A1 | 1/2010 |
| EP | 0 393 726 | A1 | 10/1990 |
| EP | 0 476 447 | A1 | 3/1992 |
| EP | 0 486 448 | A1 | 5/1992 |

* cited by examiner

DEVICE AND METHOD FOR LABELLING INDIVIDUAL PACKAGES FROM THE UNDERSIDE OF THE PACKAGE

CROSS-REFERENCE TO RELATED PATENT APPLICATIONS

This patent application is a continuation of International Application No. PCT/EP2012/051449 filed on Jan. 30, 2012, which claims the benefit of International Application No. PCT/EP2011/051304 filed on Jan. 31, 2011, the teachings and disclosure of which are hereby incorporated in their entirety by reference thereto.

FIELD OF THE INVENTION

The invention relates to a device and a method for labelling individual packages, comprising a feed unit for, in particular, the horizontal transportation of the package, a printing device for printing a label detachably affixed to a carrier strip and an application unit for applying the printed label to the package.

BACKGROUND OF THE INVENTION

A device of the kind mentioned in the beginning is known from the DE 10 2007 034 698 A1. A device of this kind on the one hand comprises one or more conveying sections for the transportation of packages and on the other hand comprises an application unit in order to apply the label printed by a printer to the underside of the package. To this end it is necessary for the labels to be supplied to the underside of package in the free space available there and to be applied in the correct position. With the known device therefore provision has been made for the label to be applied by means of a contact pressure element. Transportation of the printed label from the printer into the area of the free space below the package is effected by a transport belt which is inclined at a angle. A design of this kind requires a comparatively large amount of technical effort and is limited as regards user friendliness because access to the printer is difficult due to it being arranged below the feed unit.

Another labelling device known from the state of the art (DE 10 2008 032 019 A1) comprises a manipulator arm at the lower end of which a stamping head is provided. The upper end of the manipulator arm is attached to a bar, wherein the manipulator arm is linearly movable along the bar. By moving the manipulator arm in a suitable manner the labels are picked up by a label dispensing unit at a first position, are then transported to a further position and at this location are applied onto the goods from the topside.

BRIEF SUMMARY OF THE INVENTION

Embodiments of the invention are based on the requirement to develop a device and/or a method of the kind mentioned in the beginning in such a way that maximum operator comfort is at achieved during application of the printed label onto the package and that there is great flexibility with regard to the label length used.

According to embodiments of the invention this requirement is met by a device of the kind mentioned in the beginning in that the printing device (23) arranged laterally outside the feed unit (2) includes a label dispensing unit for dispensing the printed label (4) with at least one directional component contrary to the transport direction (f) of the package (1), and in that the application unit (5) includes a manipulator means (6, 7, 9) movable along an axis (8) extending essentially transversely to the transport direction (f) for the label (4) such that the label (4) dispensed by the carrier strip (3) can be transferred onto the feed unit (2) laterally outside the same in a first axial position of the manipulator means (6, 7, 9) and in the second axial position of the manipulator means (6, 7, 9) can be brought close to the package (1) and from there can be applied to the underside of the package (1).

With a method of the kind mentioned in the beginning this requirement is met in that the printed label (4), in a direction inclined contrary to the transport direction (f) of the package (1), is dispensed by the printing device (23) arranged laterally outside the feed unit (2), and in that the printed label (4) detached from the carrier strip (1) is transferred to the application unit (5) configured as a manipulator means (6, 7, 9) with an axis essentially extending transversely to the transport direction, in a first axial position of the application unit (5), and, in a second axial position of the application unit (5), is brought into close vicinity with the package (1) and from there is applied to the underside of package (1).

The invention is characterised in that high reproducibility is achieved in applying the label. The printed label is transferred onto the manipulator means in the area of the dispensing edge which is arranged as part of the printer, spaced-apart from the feed unit, and is applied to the predetermined position on the package. The movement performed for this purpose by the manipulator means is composed of a longitudinal movement, in order to bring the label from a position laterally spaced-apart from the feed unit, into a position close to the package, and of a pivotal movement. Both movement operations intrinsically separately from each other can also be coupled with one another. The pivotal movement preferably takes place in the area close to the package, in particular below the package. This will result in a high degree of freedom for the manipulation of the label.

Good reproducibility of the operation is achieved also in particular due to the fact that there is only one transfer place for the label. Due to the spatial separation of the printing device from the transport device for the packages, which is due to the solution according to the invention, it is then possible to proceed independently of the application position of the label onto the package (from below, from above, from the side), in the normal way with a commonly used printer designed for labelling from above. The printer can be easily supplied from its topside with the label carrier strips. In principle the printer can be positioned on either side, i.e. on the right side or left side of the plant, which results in high flexibility. Moreover there remains sufficient free space below the transport belt.

Preferred embodiments are revealed in the sub-claims:

Preferably the manipulator means comprises a conveying carriage which is guided along an axis, wherein a positive lock is formed between conveying carriage and axis. Guidance may be formed by a plurality of parallel axes which extend through bores in the conveying carriage. This will result in an especially stable embodiment.

Since the decisive factor is a conveying carriage with a minimum of mass, this preferably comprises recesses in the material areas which are not required for guiding the one or more axes. Preferably the material used for the conveying carriage consists of plastic reinforced with carbon fibre or optical fibre.

The drive for the conveying carriage is preferably motor-driven, wherein for example a step motor or linear motor is of advantage if the targeted end position shall be able to be varied. If the end position is fixed the drive may be a pneumatic drive.

Apart from the conveying carriage the manipulator means advantageously also comprises a suction foot for picking up the printed label detached from the carrier strip, which is connected with the conveying carriage via a telescopic arm. This has the advantage that an optimal axial adaptation to the pick-up position of the label and in particular also, a rotary movement of the label about the axis of the telescopic arm are possible.

For picking-up the label the suction foot preferably comprises air passage openings, which during pick-up of the label are acted upon by suction air and during application of the label to the underside of the goods can be acted upon by compressed air.

In one embodiment of the invention the manipulator means interacts with a dispensing edge of the printing device, at which the printed label is detached from the carrier strip, so that the detached label is handed over to the manipulator means in a simple but highly reproducible manner. Particularly during this phase of the transfer of the label from the dispensing edge to the suction foot of the manipulator means, a very high positioning accuracy is achieved.

According to a special embodiment of the invention the dispensing edge is associated with an intermediate storage element for the label prior to its transfer onto the manipulator means. This design has the particular advantage that feeding of the detached label is decoupled from the movement of the manipulator means as such. For example, during the time that the label remains on the intermediate storage element, the manipulator means may still be in a position outside the transfer position. This means that the labelling operation can be carried out at considerably increased speed because one or more subsequent labels can be printed during manipulation of previous labels.

In order to make transfer of the label as rigid as possible, the intermediate storage element used advantageously may be a frame element, which forms the transfer area of the label onto the manipulator means. The frame element comprises two axis-parallel runners which can be set at a variable distance from each other. This means that adaptations to various widths of label are possible. If the suction foot comprises at least one recess which can interact with the frame element, in particular in a positively locking manner, an advantageous solution is achieved if the foot of the manipulator protrudes beyond at least one of the runners, in particular past the rear runner in transport direction of the packages.

As an alternative to the frame element the intermediate storage element may be configured as a depositing belt which comprises a tapered edge as a hand-over point for the label. Here too, high spatial reproducibility is maintained.

Finally the intermediate storage element may consist of a holding plate associated with the dispensing edge, which holding plate preferably comprises an adhesion-reducing surface. Further preferably the holding plate comprises air passage openings.

The solution according to the invention offers several ways of positioning the label on the package. Apart from the more commonly used label application from the topside of package, application from the underside of the package represents a special case. For this type of application use is made either of a gap formed for the package feed between individual transport belts or of a recess formed below the transport path. Application of the label is preferably supported by a blow nozzle which is directional.

Application of the label from the side is also possible and advantageously this would be effected such that the manipulator means feeds the label close to the application position into a position parallel thereto, and the label is then placed in the desired position by means of compressed air effective across its total surface and directed through the openings in the suction foot (so-called blow-off). This blow-off operation can also be used in cases where the labels are applied from the topside or the underside.

In a preferred design of the invention provision is further made for the manipulator means to be pivotable about its axis essentially extending in transverse direction, wherein the holding plate is bent to form a bending radius adapted to the pivoting movement of the manipulator means. This offers the possibility of adapting it to different label lengths. Depending upon the length of the dispensed label it covers a more or less large arc length of the holding plate.

BRIEF DESCRIPTION OF THE DRAWINGS

The invention will now be described in detail with reference to the drawings, in which.

DETAILED DESCRIPTION OF THE INVENTION

Figure 1:
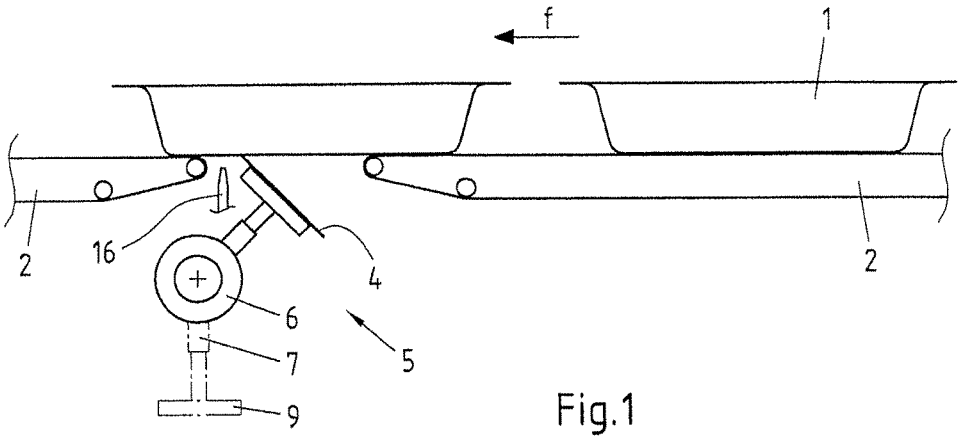
FIG. 1 shows a cross-section through a first embodiment of the invention, in which a label is applied to the underside of the package.

As shown in FIG. 1 the device for labelling packages 1 according to a first embodiment of the invention comprises a horizontal feed unit formed for example of two endless belts 2 serving as feed units, on whose topside the packages 1 are individually transported in transport direction (f). On the underside of a package 1 in the area of a distance between two feed units 2 there is an application unit 5, by means of which a printed goods label shall be applied to the underside of the package 1. A blow nozzle 16 is used to support application of the label 4 onto the underside of the package 1.

FIG. 1 shows a manipulator means 6, 7, 9 which is used to transport the label 4 from a dispensing position shown by a broken line to an application position shown by continuous lines. As revealed in FIG. 2 the manipulator means 6, 7, 9 consists of a conveying carriage 6 which can be moved along an axis 8 in a direction marked a. The movement is effected by a motorised drive not shown in FIG. 2.

In radial direction from the conveying carriage 6 and connected thereto, there extends a telescopic arm 7 at the end of which, which faces away from the conveying carriage 6 a suction foot 9 is arranged as a holding means for the label 4. The suction foot 9 can be moved by means of the telescopic arm 7 both axially in direction b relative to the conveying carriage 6 and in the shown pivoting direction about axis b of the telescopic arm 7.

Figure 2:
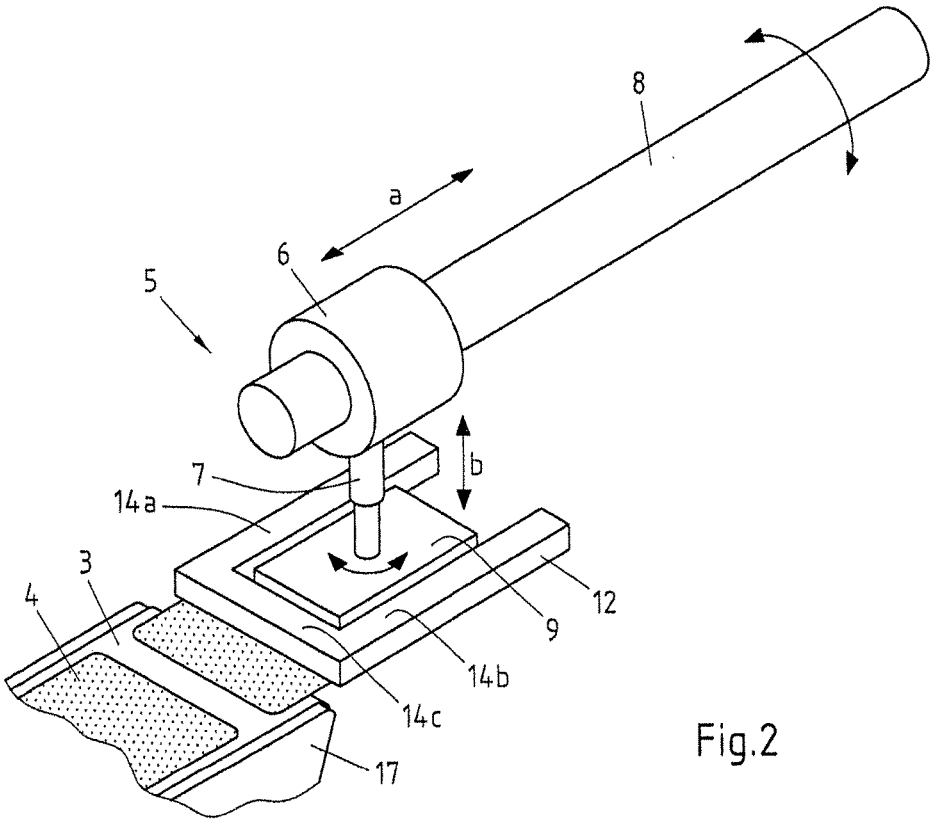
FIG. 2 shows a first variant of a spatial view of the embodiment shown in FIG. 1.

Further, as indicated in the upper right-hand part of FIG. 2 by the arrow direction the entire unit comprised of conveying carriage 6, telescopic arm 7 and suction foot 9 can be pivoted on the axis 8 within an angle range of for example 135 degrees.

As shown in the lower left-hand part of FIG. 2 the labels 4 printed by the printer (not shown) are arriving lying on the carrier strip 3. Due to the fact that the carrier strip 3 is guided around a dispensing edge 17 configured as part of the printer, the label 4 detaches itself from the carrier strip 3 and is guided into an area in which it is taken over by the manipulator means 6, 7, 9. This area is formed by a stationary frame part 12, which consists of two axis-parallel runners 14*a*, 14*b* and a web 14*c* connecting the same. Due to openings 15 (see FIG. 5) formed in the runners the label 4 is held on the frame part 12 by means of suction air. The frame part 12 also serves as intermediate storage for the label 4, before it is taken over by the suction foot 9 and transported further by the manipulator means 6, 7, 9.

Figure 7:
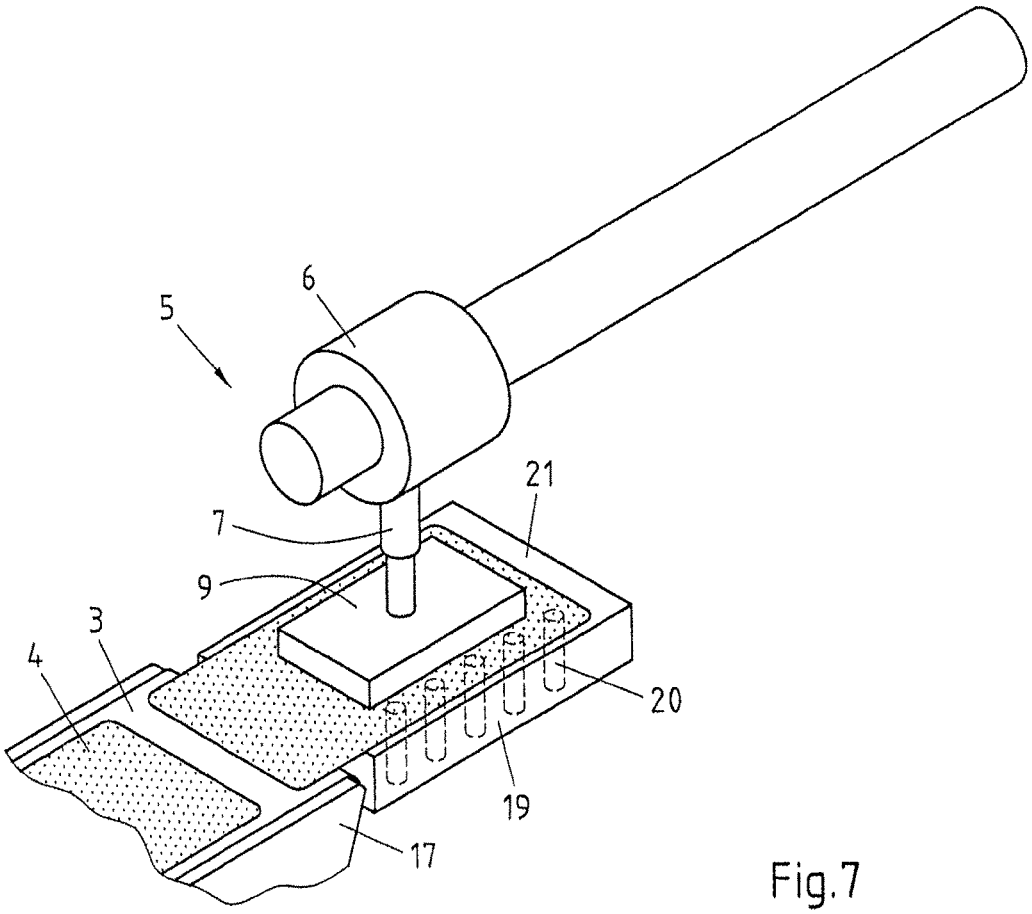
FIG. 7 shows a second variant of a spatial view of the embodiment shown in FIG. 1.

In a variant shown in FIG. 7 of the drawing the label 4 is held by a holding plate 19 provided with an adhesion-reducing layer 21.

Figure 3A:
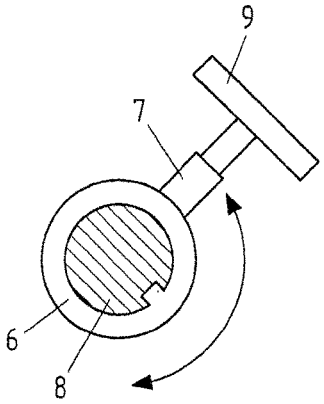
FIGS. 3*a*, 3*b*, 3*c* show respectively different designs of a manipulator means, which is used in the embodiment of the invention according to FIG. 1.

According to FIG. 3*a* the cross-section of axis 8 is circular and is connected, via a tongue-and-groove connection, with the conveying carriage 6 in a positively locking manner.

Figure 3B:
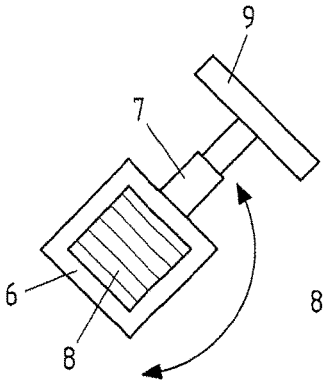

According to FIG. 3*b* the cross-section of axis 8 comprises a square or other suitable profile thereby obviating the need for further positively-locking connecting means.

Figure 3C:
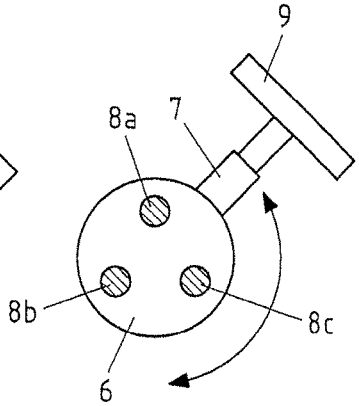

According to FIG. 3*c* three axes 8*a*, 8*b*, 8*c* are provided which respectively extend through the conveying carriage 6.

Figure 4:
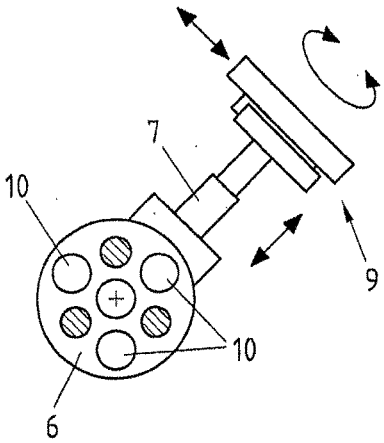
FIG. 4 shows a further design of the manipulator means.

In a further development of the embodiment according to FIG. 3*c*, FIG. 4 shows that further bores 10 are provided additionally in the material areas of the conveying carriage 6 outside the areas, in which the axes 8*a*, 8*b*, 8*c* extend, in order to achieve a corresponding weight reduction of the conveying carriage 6. In other respects FIG. 4 also shows movement options of the suction foot 9 already described in conjunction with FIG. 2, with respect to the conveying carriage 6.

A suitable driving means for the axial feed of the manipulator is a spindle. Radial movement could be accomplished by a rotating cylinder or a cylinder with a hinged connection.

Figure 5:
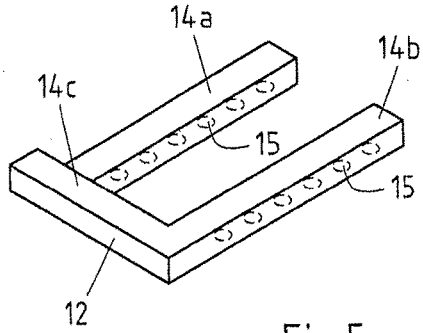
FIG. 5 shows an embodiment of a frame element.

FIG. 5 shows a separate illustration of the frame element 12, consisting of runners 14, 14*b* and the web 14*c* connecting them. In addition openings 15 are provided for the passage of air on the underside of the frame element 12, i.e. on the side on which the label 4 is positioned.

Figure 6:
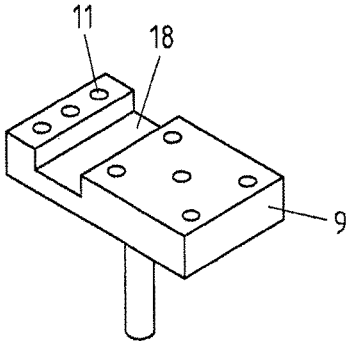
FIG. 6 shows an embodiment of a suction foot of the manipulator means.

FIG. 6 shows an embodiment for the suction foot 9, which comprises a recess 18 as well as air passage openings 11 on its underside accepting the label 4.

FIG. 7 shows a variant of the embodiment shown in conjunction with FIG. 2. Identical reference symbols describe corresponding elements. In this embodiment also, the carrier strip 3 is guided around a dispensing edge configured as part of the printer, wherein the label 4 detaches itself from the carrier strip 3 and is guided into the area of the manipulator means (6, 7, 9). With this variant a holding plate 19 is provided which comprises an adhesion-reducing surface 21 which is used to deposit the label 4 detached from the carrier strip 3. In order to securely hold the label 4 in the deposited position, the holding plate 19 comprises air passage openings 20 for creating an under-pressure on the topside of the holding plate 19.

Instead of the holding plate 19 a depositing belt according to a further variant (not shown in the drawing) may be provided. In this case the movement of the depositing belt is synchronised with the movement of the manipulator means. Due to forming a correspondingly tapered edge at the hand-over position the label will detach easily prior to it being handed over to the suction foot.

The device described operates as follows:

Following, as required, a possible process of weighing the package 1 fed in transport direction f, the label 4 present on the carrier strip 3 is printed in the printer arranged laterally of the device shown in FIG. 1. The printed label 4 is carried on the carrier strip 3, as shown in FIG. 2, in direction of the dispensing edge 17 and detached from the carrier strip 3. The spatial area in which the label 4 is taken over by the suction foot 9 of the manipulator means 6, 7, 9 is formed by the frame element 12. Depending on the width of the labels 4 the frame element 12 can be modified by varying the distance between the runners 14*a*, 14*b*.

The label 4 is fixed through corresponding suction air openings on the underside of the frame element 12 and in this position is taken over by the suction foot 9 of the manipulator means 6, 7, 9. Thereafter it is present on the underside of the manipulator means 6, 7, 9 shown in FIG. 2. To this end the suction foot 9 of the manipulator means 6, 7, 9 can be moved out in arrow direction b. Subsequently the suction foot 9 is retracted and the label 4 is rotated with the suction foot 9 as required. The manipulator means 6, 7, 9 is then moved along axis 8 into a position below the package 1, as shown for example in FIG. 1.

In this so-called application position the suction foot 9 of the manipulator is pivoted to the extent where the label 4 is arranged in the area of the underside of the package 1 and taken over by the package. By moving the telescopic arm out and then retracting it, application of the label 4 onto the underside of the package 1 can be implemented in a particularly advantageous manner. The application process can be supported by the action of the blow nozzle 16. Subsequently the manipulator means 6, 7, 9 returns into its starting position as shown in FIG. 2.

Due to the solution according to the invention the label 4 can be positioned very accurately as there exists a direct spatial association between take-over in the dispensing position of the label 4 and its affixation on the underside of the package 1 in the application position. Another factor is great user-friendliness because the printer, for loading the carrier strips 3, is in a comfortably high position. And because lateral positioning is possible on either side, there exists great flexibility in the use of the plant.

In a variant to FIG. 2 shown in FIG. 7, the printed label 4, after detaching it, is deposited on the holding plate 19, whereupon it is then in the area of the underside of the manipulator means 6, 7, 9 shown in FIG. 2. The area in which the label 4 is taken over by the suction foot 9 of the manipulator means 6, 7, 9, is then determined by the holding plate 19, which on its surface 21 facing the underside of the label 4 comprises a coating which reduces or completely excludes adhesion.

The label 4 is fixed on the surface 21 of the holding plate 19 by suitable suction air openings 20 and from here is taken over by the suction foot 9 of the manipulator means 6, 7, 9. To this end, as described in the context of FIG. 2, the suction foot 9 of the manipulator means 6, 7, 9 can be moved out in arrow direction b. Take-over may also be accomplished by a simultaneous process of the label being blown off the holding plate and being sucked up by the manipulator means.

Figure 8:
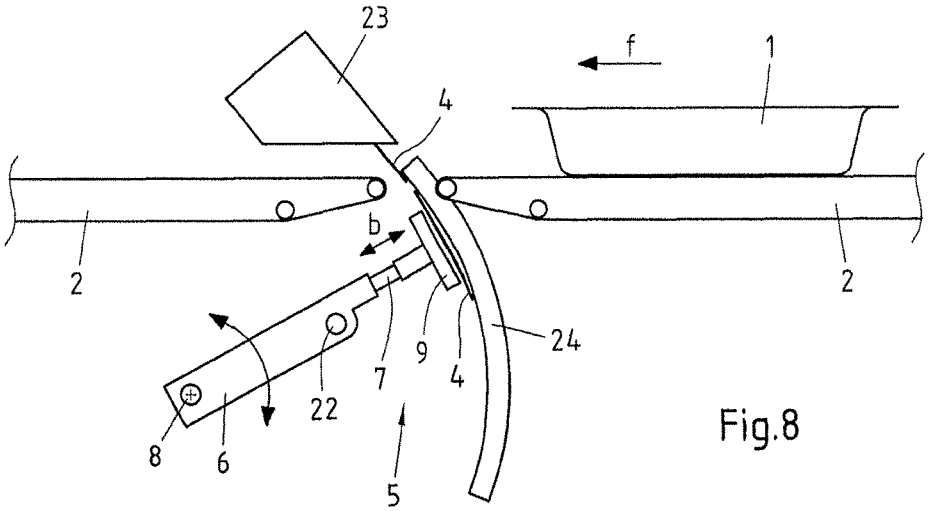
FIG. 8 shows a cross-section through a second embodiment of the invention.
Figure 9:
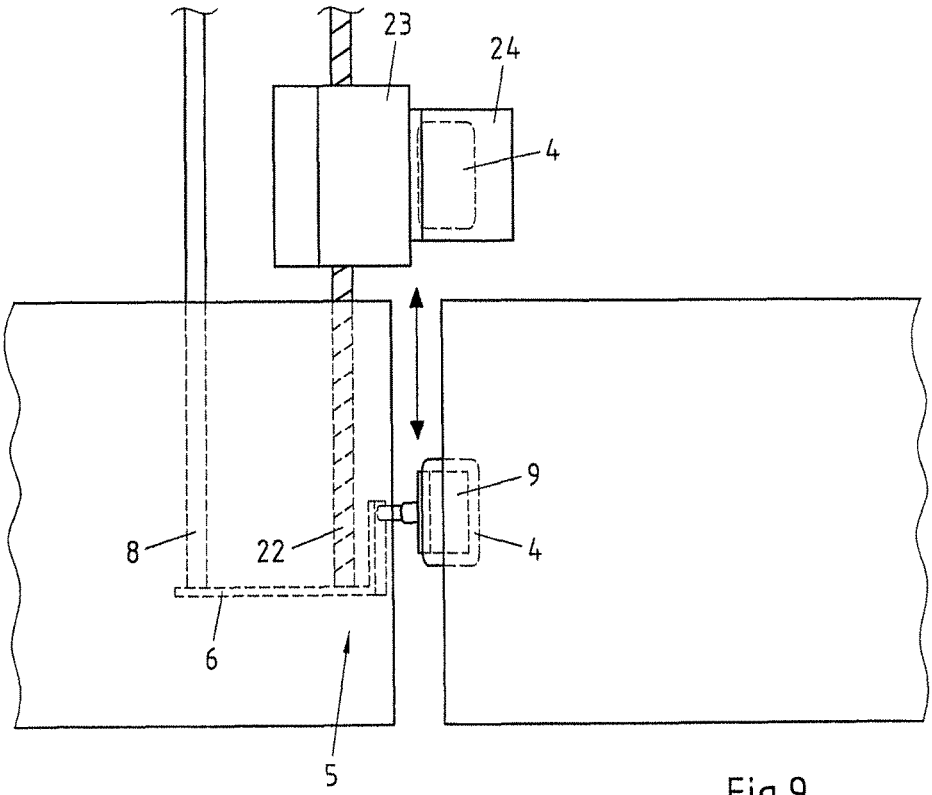
FIG. 9 shows a top view of the second embodiment shown in FIG. 8.

The second embodiment shown in FIGS. 8 and 9 for a conveying system according to the invention is described below:

This is different from the first embodiment described above in that the printing device 23 is arranged laterally of the feed unit 2 and, as regards the dispensing direction for the labels relative to the vertical, is inclined by a defined angle in the opposite direction to the conveying direction f, as shown in FIG. 8. As a result the dispensing direction and the feed direction point in opposite directions. Preferably the angle of inclination relative to the horizontal is 45 degrees.

Following, as required, a possible process of weighing the package 1 fed in transport direction f, the label 4 present on the carrier strip 3 is printed in the printer 23 arranged laterally of the device shown in FIG. 1. The printed label 4 is carried on the carrier strip 3, as shown in the upper part of FIG. 9, in direction of the dispensing edge 17 and detached from the carrier strip 3. The spatial area in which the label 4 is taken over by the suction foot 9 of the manipulator means 6, 7, 9 is formed by the holding plate 24. The holding plate 24 is shaped as an arc. The radius of the arc is adapted to the rotating movement of the manipulator means 6, 7, 9. Depending on the length of the label to be handed over, either the entire length of the arc of the holding plate 24 or only a part thereof is utilised. The place in which the suction foot 9 is set down is, as shown in FIG. 8, approximately central to the label width and, if advantageous, central also to the label length. This is achieved by a corresponding axial and radial movement of the manipulator means about its fulcrum and along axis 8.

The label 4 is affixed to the underside of the holding plate 24, in particular by applying an under-pressure, and at this point is taken over by the suction foot 9 of the manipulator means 6, 7, 9. To this end the suction foot 9 of the manipulator means 6, 7, 9 may be moved out in arrow direction b. A combination of blowing and sucking is also possible. Thereafter the suction foot 9 is refracted and the manipulator means 6, 7, 9 is moved along axis 8 into a position below the package 1, as shown in FIG. 9.

In this application position the suction foot 9 of the manipulator is pivoted until the label 4 is in the area of the underside of the package 1 and is taken over by the package. By extending the telescopic arm 7 and subsequently retracting it application of the label 4 onto the underside of the package 1 can be accomplished in a particularly advantageous way. The application process may be supported by the action of a blow nozzle (not shown). The manipulator means 6, 7, 9 then returns into its starting position.

As a result of this design labelling is effected involving a "pendulum motion" of the manipulator means in that the manipulator means uses a pendulum motion to collect the label from the print head, then moves to the labelling position in a linear transverse motion below the package, applies the label to the bottom of the package again effecting a pendulum motion, then swings back and finally returns linearly along the transverse path.

The labelling process using this variant is particularly advantageous since the printer is attached laterally of and above the feed unit. The area below the conveying system remains substantially free.

The system is also very user-friendly because the printer is in a comfortably high position for loading the carrier strips 3. And because positioning of the application unit is possible on both the right-hand and left-hand side either side of the conveyor system, there exists great flexibility in the use of the plant.

LIST OF REFERENCE SYMBOLS

1—package
2—endless belts
3—carrier strip
4—label
5—application unit
6—conveying carriage
7—telescopic arm
8—axis
9—suction foot
10—bores
11—air passage openings
12—frame part
14*a, b*—runners
14*c*—web
15—openings
17—dispensing edge
18—recess
19—depositing plate
20—air passage openings
21—adhesion-reducing layer
22—threaded spindle
23—printer
24—holding plate

The invention claimed is:

1. A device for labelling individual packages (1), comprising a feed unit (2) for transporting the package (1), horizontally, a printing device (23) for printing a label (4) detachably affixed to a carrier strip (3) and an application unit (5) for applying the printed label (4) onto the package (1), wherein the printing device (23) arranged laterally outside the feed unit (2) includes a label dispensing unit for dispensing the printed label (4) in a dispensing direction which, relative to the vertical, is inclined by a defined angle in the opposite direction to a transport direction (f) of the package (1), and in that the application unit (5) includes a manipulator means (6, 7, 9) movable along an axis (8) essentially extending transversely to the transport direction (f) for the label (4) such that the label (4) dispensed by the carrier strip (3) can be transferred onto the feed unit (2) in a first axial position of the manipulator means (6, 7, 9) laterally outside the feed unit (2) and in the second axial position of the manipulator means (6, 7, 9) can be brought to a position underneath and close to the package (1) and from there can be applied to the underside of the package (1).

2. The device according to claim 1, wherein the manipulator means (6, 7, 9) comprises a conveying carriage (6) which can be moved along an axis (8) using a motor.

3. The device according to claim 2, wherein the manipulator means (6, 7, 9) is associated with a plurality of parallel axes (8*a*, 8*b*, 8*c*) which extend through bores (10) in the conveying carriage (6).

4. The device according to claim 3, wherein the conveying carriage (6) comprises further bores (10) extending along the plurality of parallel axes (8*a*, 8*b*, 8*c*).

5. The device according to claim 1, wherein the axis (8) is in engagement with the conveying carriage (6) in a positively locking manner.

6. The device according to claim 5, wherein the positive lock is formed by imparting a profile to the axis (8) which is square-shaped or star-shaped.

7. The device according to claim 1, wherein the manipulator means (6, 7, 9) is driven by a step motor, in particular via a toothed belt with a pinion.

8. The device according to claim 1, wherein the manipulator means (6, 7, 9) can be pneumatically moved.

9. The device according to claim 1, wherein the manipulator means (6, 7, 9) comprises a suction foot (9) which can be moved out via a telescopic arm (7) for receiving the printed label (4) detached from the carrier strip (3).

10. The device according to claim 9, wherein the suction foot (9) comprises air passage openings (15).

11. The device according to claim 9, wherein the manipulator means (6, 7, 9) interacts with a dispensing edge (17) of the printing device, at which the printed label (4) is detached from the carrier strip (3) and transferred to the manipulator means (6, 7, 9).

12. The device according to claim 11, wherein the dispensing edge (17) is associated with an intermediate storage element for the label (4) prior to transfer of the label onto the manipulator means (6, 7, 9).

13. The device according to claim 12, wherein the intermediate storage element is formed by a frame element (12).

14. The device according to claim 13, wherein the frame element (12) comprises at least two axis-parallel runners (14*a*, 14*b*) the distance of which from each other is variable.

15. The device according to claim 13, wherein the frame element (12) comprises air passage openings (15) at least on the surface facing the label (4).

16. The device according to claim 12, wherein the suction foot (9) comprises at least one recess (18) which interacts with the frame element (12), and engages with it in a positively locking manner.

17. The device according to claim 12, wherein the intermediate storage element is formed by a depositing belt.

18. The device according to claim 17, wherein the depositing belt comprises an edge tapered towards the manipulator means for the label.

19. The device according to claim 12, wherein the intermediate storage element is comprised of a holding plate (19, 24) associated with the dispensing edge (17), which forms a transfer area of the label (4) onto the manipulator means (6, 7, 9).

20. The device according to claim 19, wherein the holding plate (19) comprises an adhesion-reducing surface (21).

21. The device according to claim 19, wherein the holding plate (19) comprises air passage openings (20).

22. The device according to claim 19, wherein the manipulator means (6, 7, 9) for the label (4) is pivotable about the axis (8) thereof extending transversely to the transport direction (f).

23. The device according to claim 22, wherein the holding plate (24) is bent to a bending radius adapted to a pivoting movement of the manipulator means.

24. The device according to claim 23, wherein a dispensing direction for the labels is 45 degrees relative to the horizontal.

25. The device according to claim 1, wherein a weighing unit is arranged in a transport path of the package (1).

26. A method for labelling individual, in particular horizontally transported packages (1), wherein a label (4) detachably affixed to a carrier strip (3) is printed by a printing device, is detached from the carrier strip following printing and is applied to the package (1) by means of an application unit (5), wherein the printed label (4) is dispensed by the printing device (23) arranged laterally outside the feed unit (2) in a dispensing direction which, relative to the vertical, is inclined by a defined angle in the opposite direction to a transport direction (f) of the package (1), and in that the printed label (4) detached from the carrier strip (3) is transferred, in a first axial position of the application unit (5), which is configured as a manipulator means (6, 7, 9) with an axis extending transversely to the transport direction, onto the same and, in a second axial position of the application unit (5), is brought to a position underneath and close to the package (1) and from there is applied to the underside of the package (1).

27. The method according to claim 26, wherein application of the label (4) onto the package (1) is effected via a pivoting movement of the manipulator means (6, 7, 9).

28. The method according to claim 27, wherein application of the label onto the underside of the package (1) is effected through a recess, formed between individual transport belts.

29. The method according to claim 26, wherein application of the label onto the underside of the package (1) is effected by a blow nozzle (16) directed vertically upwards.

30. The method according to claim 26, wherein the printed label (4), detached from the carrier strip (3), is initially transferred onto an intermediate storage element (12, 19) and from there is taken over by the application unit (5) in its first axial position.

31. The method according to claim 30, wherein the label is rotated during its transport from the take-over to a handover place.

* * * * *